US006397816B1

(12) United States Patent
Pursifull

(10) Patent No.: US 6,397,816 B1
(45) Date of Patent: Jun. 4, 2002

(54) THROTTLE POSITION CONTROL METHOD AND SYSTEM

(75) Inventor: Ross Dykstra Pursifull, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 11 days.

(21) Appl. No.: 09/694,398

(22) Filed: Oct. 23, 2000

(51) Int. Cl.[7] ..... F02D 11/00; F02D 9/10
(52) U.S. Cl. ..... 123/399; 123/361
(58) Field of Search ..... 123/399, 361, 123/352; 701/101, 102, 110

(56) References Cited

U.S. PATENT DOCUMENTS 4,885,935 A * 12/1989 Feller et al. ..... 73/117.2
4,941,444 A * 7/1990 Fujita ..... 123/361
4,984,454 A * 1/1991 Feller et al. ..... 73/117.3
5,526,787 A * 6/1996 Pallett ..... 123/399
5,606,951 A * 3/1997 Southern et al. ..... 123/399
6,178,371 B1 * 1/2001 Light et al. ..... 701/110
6,199,004 B1 * 3/2001 Russell et al. ..... 701/54

* cited by examiner

*Primary Examiner*—William C. Doerrler
*Assistant Examiner*—Hieu T. Vo
(74) *Attorney, Agent, or Firm*—John E. Kajander

(57) ABSTRACT

A method for controlling a throttle of an electronic throttle control-equipped engine. The method includes the steps of providing a desired throttle position derived from the driver demand and vehicle system requests. The method generates first and second throttle positions by interpolating the desired throttle position within the resolution of the throttle position controller. A duty cycle is also generated as a function of the desired throttle position and system resolution. The resulting conditioned throttle position command having the first throttle position for a first time period and the second throttle position for a second time period is communicated to the throttle controller. The ratio of the time periods corresponds to the duty cycle such that the average throttle position command is approximately equal to the desired throttle position. In this way, the control method can achieve a desired throttle position of higher resolution than the throttle position sensing system.

17 Claims, 2 Drawing Sheets

THROTTLE POSITION CONTROL METHOD AND SYSTEM

BACKGROUND OF THE INVENTION

The present invention is directed to a control system and method for internal combustion engines, and more particularly, concerns a throttle position control scheme for electronic throttle control-equipped vehicles.

Electronic airflow control systems such as electronic throttle control systems, replace traditional mechanical throttle cable systems with an "electronic linkage" provided by sensors and actuators in communication with an electronic controller. This increases the control authority of the electronic controller and allows the airflow and/or fuel flow to be controlled independently of the accelerator pedal position. Electronic throttle control systems include mechanisms for positioning the throttle plate in response to the driver demand and other vehicle system constraints such as a traction control system.

The most common positioning mechanism is a positioning motor. A closed-loop feedback position controller typically responds to a discrete throttle position value and commanded throttle position. Because the feedback signal is an analog signal that has been discretized by an analog-to-digital converter, its resolution is quantized and may not precisely correlate to a commanded steady-state throttle position. Thus, there is a need for an improved throttle position control system and method.

SUMMARY OF THE INVENTION

Accordingly, it is an object of the present invention to provide an improved throttle position control scheme. According to the present invention, the foregoing and other objects are obtained by a method for controlling a throttle of an electronic throttle control-equipped engine. The method comprises the steps of providing a desired throttle position derived from the driver demand and vehicle system requests. The method generates first and second throttle positions by straddling the desired throttle position within the resolution of the throttle position controller. A duty cycle is also generated as a function of the desired throttle position and system resolution. The resulting conditioned throttle position command comprising said first throttle position for a first time period and said second throttle position for a second time period is communicated to the throttle controller. The ratio of the time periods corresponds to the duty cycle such that the average throttle position command is approximately equal to the desired throttle position. In this way, the control method can achieve a desired throttle position which is, on average, of higher resolution than the throttle position sensing system.

An advantage of the present invention is that it provides higher resolution of the throttle position control. Another advantage is that the present method more accurately corresponds to the commanded steady-state throttle position as determined from the driver demand. Other objects and advantages of the invention will become apparent upon reading the following detailed description and appended claims, and upon reference to the accompanying drawings.

BRIEF DESCRIPTION OF THE DRAWINGS

For a more complete understanding of this invention, reference should be made to the embodiments illustrated in greater detail in the accompanying drawings and described below by way of examples of the invention.

In the drawings.

DETAILED DESCRIPTION OF THE INVENTION

Figure 1:
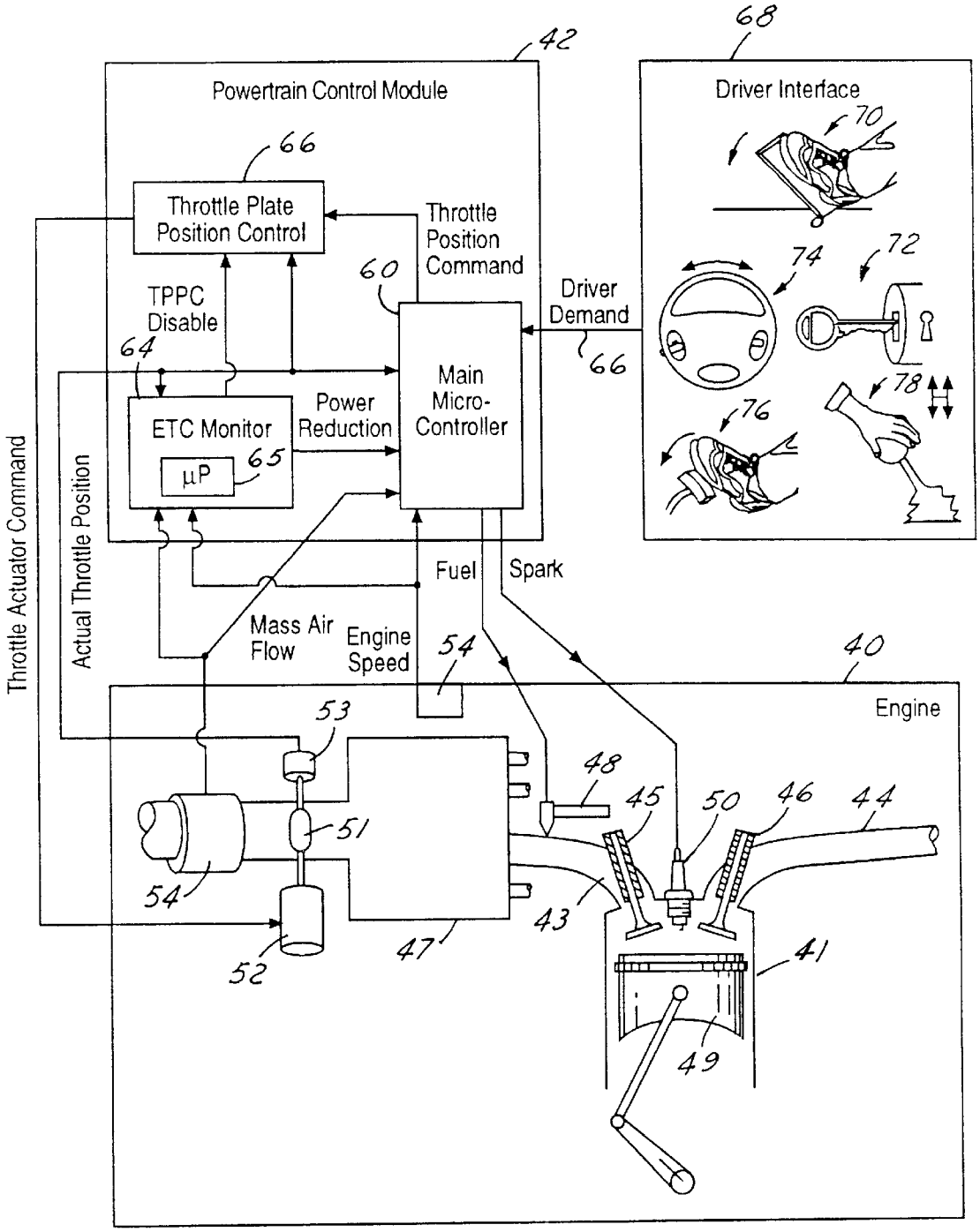
FIG. 1 is a schematic diagram of an internal combustion engine and associated electronic throttle control and operator input systems in accordance with one embodiment of the present invention.

Referring now to FIG. 1, there is shown a schematic diagram of an internal combustion engine 40 and associated Powertrain Control Module (PCM) 42 as well as an operator interface 68 in accordance with one embodiment of the present invention. The engine 40 includes a plurality of combustion chambers 41 each having an associated intake 43 and exhaust 44 operated by a respective intake and exhaust valves 45, 46. Combustion occurs as a result of the intake of air and fuel from the intake manifold 47 and fuel injector 48 respectively, compressioned by the piston 49, and ignitioned by the spark plug 50. Combustion gases travel through the exhaust manifold 44 to the downstream catalytic converter (not shown) and are emitted out of the tailpipe. A portion of the exhaust gases may also be recirculated back through the intake manifold 47 to the engine cylinders 41.

The airflow through the intake manifold 47 is controlled by a throttle comprising a throttle plate 51 and throttle actuator 52. The throttle actuator is preferably an electronic servo motor. A throttle position sensor 53 measures the actual throttle position. The throttle position sensor is typically an analog sensor. Its output is discretized when it passes through an analog-to-digital converter such that the controller receives discrete positional values for the detected throttle position. Thus, the quandization of the positioning mechanism is typically a function of the resolution of the A to D converter. However, higher resolution typically is associated with higher cost A to D converters.

Other sensors include a mass airflow sensor 54 which measures the amount of air flowing into the engine 40. An engine speed sensor 55, provides a value indicative of the rotational speed of the engine 40.

The PCM 42 receives as inputs the discretized throttle position signal, the mass airflow signal, the engine speed signal, and any driver demand inputs, among other things. In response, the PCM 42 controls the spark timing of the spark plugs 50, the pulse width and timing of the fuel injectors 48, and the position of throttle 51 by way of the throttle actuator 52. These inputs and outputs are controlled by the main micro-controller 60. The main micro-controller 60 controls the throttle position by outputting a throttle position command to the Throttle Plate Position Controller (TPPC) 62 to drive the throttle actuator 52 to the desired position, as will be described in more detail below.

The TPPC 62 is preferably a PID controller which closed-loop controls the throttle position based primarily on an error term representing the difference between the desired and actual throttle position values. The desired throttle position can be generated by any known methods of interpreting driver demand and arbitrating it with the various vehicle system constraints such as speed control and traction control. The resulting desired intake airflow value is then factored into a formula to yield a desired throttle position command.

With regard to throttle control, the PCM 42 generates a throttle position command. The desired throttle position command is communicated to the TPPC 62. The TPPC 62 preferably conditions the throttle position command as described below with reference to FIG. 2, and communicates this signal to the closed-loop controller which is part of the TPPC 62. The closed-loop controller outputs a drive signal to the throttle actuator 52 to drive the throttle 51 to the desired position.

The PCM 42 preferably includes an Electronic Throttle Control (ETC) monitor 64 that communicates with the main micro-controller 60 and TPPC 62. The ETC monitor 64 includes a microprocessor 65 and associated memory separate from the microprocessor and the main micro-controller 60. The ETC monitor 64 receives as input the engine speed signal from the engine speed sensor 55 and throttle position signal from the throttle position sensor 53. The ETC monitor 64 then functions to monitor the throttle actuation. Although the ETC monitor 64 and TPPC 62 are shown as separate from the PCM main microprocessor, they could be partially or wholly integrated into the main microprocessor as well. Alternatively, the ETC monitor 64 and TPPC 62 can be integrated into a single controller separate from the main micro-controller 60.

The PCM 42 also receives as inputs driver demand signals 66. The driver demand signals can include such things as accelerator pedal position 70, ignition switch position 72, steering input 74, brake sensor input 76, transmission position input 78, as well as inputs from the vehicle speed control and transmission.

Figure 2:
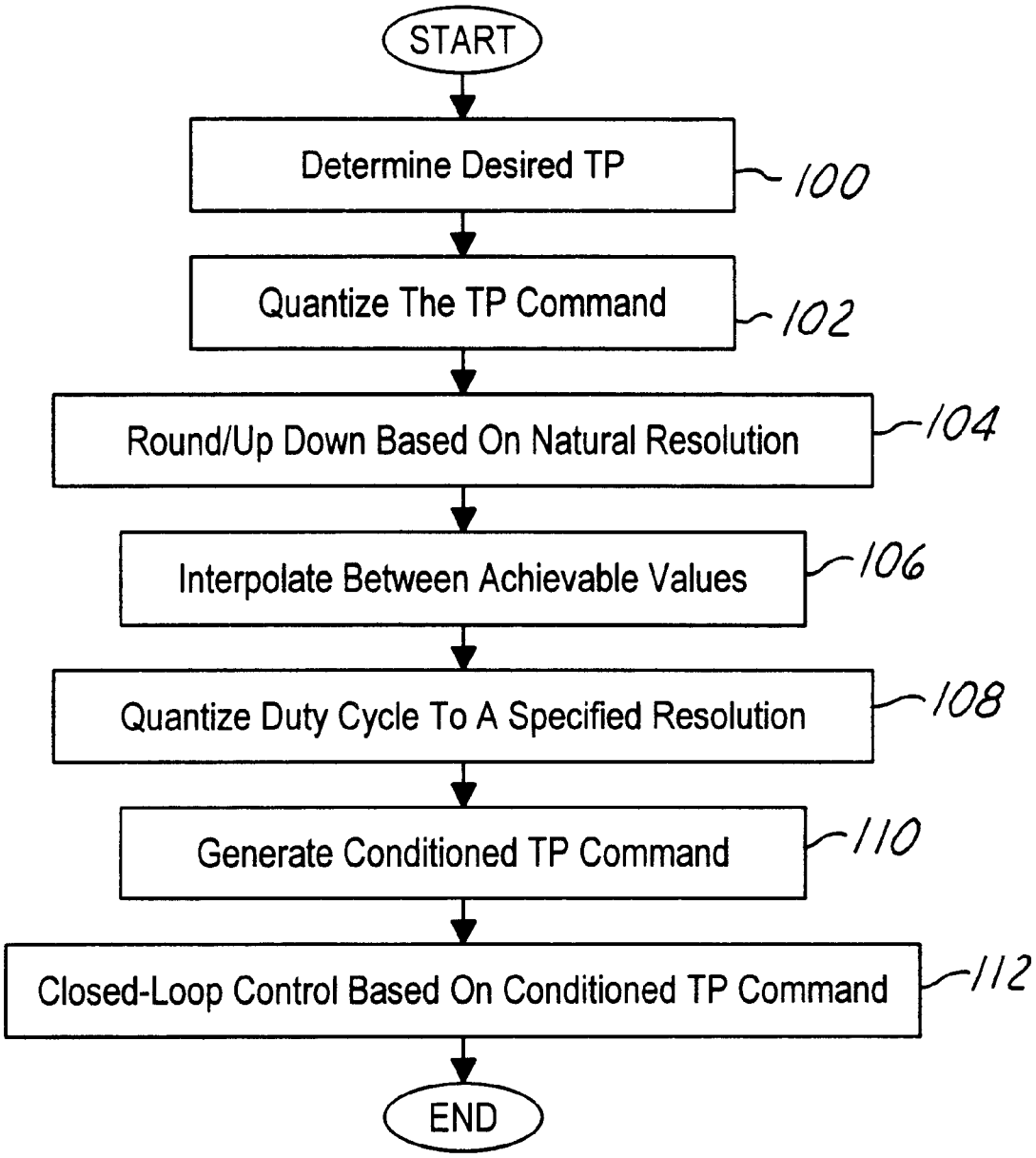
FIG. 2 is a logic flow diagram of a method of controlling the throttle position in accordance with one embodiment of the present invention.

Referring now to FIG. 2, there is a shown a logic flow diagram of a method of controlling the throttle position in accordance with one embodiment of the present invention. The method begins at step 100 by determining the desired throttle position. The desired throttle position command is preferably derived by the PCM and communicated to the TPPC. A desired or commanded throttle position can be generated by any known method but typically is a function of the accelerator pedal position input by the operator, the engine speed, the engine coolant temperature, barometric pressure, and air charged temperature. Given the driver demand, and any inputs from the speed control system and traction control system, if active, as well as any constraints imposed by engine, vehicle, or transmission speed limits, the PCM generates a desired airflow value resulting in a desired throttle position to achieve that airflow. The throttle position command can be expressed in unites of A to D counts or degrees. In a preferred embodiment, the throttle position command is expressed as opening angle degrees. Thus, in step 100, it may be necessary to convert the throttle position command (in this case, encoded as a duty cycle) duty cycle or count into degrees of throttle opening.

Because the actual throttle position signal is discretized by an A to D converter, it necessarily discretizes the position information provided to the TPPC 62. Thus, even though the commanded throttle position may effectively be continuous within the controller, the achievable steady position is discretized. For example, the actual throttle position signal may only have a resolution of 1/16 degrees of throttle opening angle. If the desired throttle opening angle is 14 5/32 degrees, a steady-state condition may result when the actual throttle position sensor value reads 14 3/16 degrees due to the discrepancy and resolution between the position controller, and the position sensor. The present invention overcomes this discrepancy and provides near-continuous resolution by generating a conditioned throttle position command comprising a duty cycle schedule between two achievable discrete positions as measured by the throttle position sensor.

In step 102, the throttle position command is quantized for easier handling by the TPPC controller. For example, the resulting throttle position command is expressed in a resolution of 1/256 degrees.

In step 104, the throttle position command is compared to the natural resolution of the A to D converter associated with the throttle position sensor. For example, the natural resolution may be 1/16 degrees. Therefore, if the commanded throttle position was 7 11/32 degrees, the rounded down throttle position would be 7 10/32 or 7 5/16 degrees, and the rounded up throttle position would be 7 6/16 degrees.

In step 106, the TPPC interplates between the two achievable throttle position values (tp_command_rd and tp_command_ru) to weight the rounded up and rounded down throttle position values relative to the commanded quantized throttle position value. This is expressed as follows:

$$\text{duty_cycle_unq}=(\text{tp_command_tp_command_rd})/\text{NATURAL_RES} \quad (1)$$

In step 108, the duty cycle is quantized to a specified resolution similarly to the commanded throttle position in step 102. This may be expressed as follows:

$$\text{duty_cycle}=\text{quantize}(\text{duty_cycle_unq},\text{DUTY_CYCLE_RES}) \quad (2)$$

wherein DUTY_CYCLE_RES is a predetermined constant such as 0.5. This step serves to simplify the controller's implementation.

In step 110, the conditioned throttle position command is generated that alternates between the rounded up and rounded down throttle positions according to the calculated duty_cycle value. For a constant period implementation, this can be expressed as follows:

$$\text{tp_command}=\text{tp_command_rd for } (1-\text{duty_cycle})*\text{PERIOD}, \text{ then tp_command_ru for } (\text{duty_cycle})*\text{PERIOD} \quad (3)$$

Thus, in the example above, if the desired throttle position from the PCM was 7 11/32 degrees, and the natural resolution of the system was 1/16 degrees, the corresponding rounded down and rounded up position values would be 7 5/16 degrees and 7 6/16 degrees, respectively. The corresponding duty cycle would also be 50%. Thus, in the case of a constant 20 msec period, the throttle position command would be 7 5/16 degrees for 10 msec and 7 6/16 degrees for 10 msec for as long as the desired throttle position was 7 11/32 degrees.

In step 112, the throttle position is driven by closed-loop feedback control according to the conditioned throttle position command generated in step 110.

An example of the present method as shown in FIG. 2 for a variable period follows. Assume that the resolution of the A to D converter associated with the throttle position sensor (the feedback signal) is 1/16 degrees. If the desired throttle opening angle position command is 5 1/64 degrees, then the conditioned throttle position command provided to the closed-loop position controller would be as follows: for 6 milliseconds, the commanded throttle position would be set to 5 degrees, and for 18 milliseconds, the commanded throttle position would be set to 5 1/16 degrees. This conditioned throttle position command is then be repeated as long as the desired throttle position command was 5 1/64 degrees. In this example, the total control period is 24 milliseconds. Depending upon the responsiveness of the controller, however, a minimum control time period is preferred to achieve a desired throttle position. In other words, a 50% duty cycle having a one millisecond dwell time at each of two commanded throttle positions, i.e., a commanded time period of two milliseconds, may be too fast to achieve the desired throttle position. Thus, it may be desirable to implement a variable control time period to ensure that the conditioned throttle position command does not generate a dwell time less than the responsiveness of the closed-loop controller. Thus, if the conditioned throttle position command were 10 percent at the rounded down value and 90 percent at the rounded up value and the minimum dwell time necessary to effectuate a response by the closed-loop controller was 4 msec, the rounded down value would be commanded for 4 msec and the rounded up value for 36 msec. This contrasts with the constant period example of 20 msec wherein the 10 percent rounded down value would be commanded for 2 msec (10 percent of 20 msec) which would be less than the response time of the closed-loop system.

From the foregoing, it can be seen that there has been brought to the art a new and improved throttle position control method which has the advantage of high resolution near, near-continuous throttle position control. While the invention has been described in connection with one or more embodiments, it should be understood that the invention is not limited to those embodiments. On the contrary, the invention covers all alternatives, modifications and equivalents as may be included within the spirit and scope of the appended claims.

What is claimed is:

1. A throttle position control system for an internal combustion engine comprising:

an electric motor responsive to a drive signal for actuating the position of said throttle;

a throttle position sensing system for detecting an actual throttle position within a first resolution value; and a controller for generating a conditioned throttle position command as a function of a desired throttle position command and said resolution value, said conditioned throttle position command comprising a first commanded throttle position for a first time period and a second commanded throttle position for a second time period such that an average throttle position command over said first and second time periods has a second resolution value which is greater than said first resolution value.

2. The throttle position control system of claim 1 wherein the sum of the first and second predetermined periods of time is constant for each desired throttle position command.

3. The throttle position control system of claim 1 wherein the sum of the first and second predetermined periods of time is variable for each desired throttle position command.

4. A method for controlling a throttle of an electronic throttle control-equipped engine, the method comprising the steps of:

providing a desired throttle position value;

providing a resolution value corresponding to a minimal throttle position increment resolution;

generating first and second throttle position values as a function of the desired throttle position value and said resolution value;

generating a duty cycle value as a function of said desired throttle position value and said resolution value; and generating a conditioned throttle position command as a function of said first and second throttle position values and said duty cycle value.

5. The method of claim 1 further comprising the step of communicating said conditioned throttle position command to a throttle position controller.

6. The method of claim 5 wherein the step of generating said first and second throttle position values includes the steps of generating a rounded down throttle position value less than said desired throttle position value and a rounded up throttle position value greater than said desired throttle position value.

7. The method of claim 6 wherein the step of communicating includes communicating said rounded down throttle position value for a first predetermined period of time and communicating said rounded up throttle position value for a second predetermined period of time such that the ratio of said first and second time periods corresponds to said duty cycle value.

8. The method of claim 7 wherein the sum of the first and second predetermined periods of time is constant for each desired throttle position value.

9. The method of claim 7 wherein the sum of the first and second predetermined periods of time is variable for each desired throttle position value.

10. The method of claim 4 wherein the step of generating a duty cycle value includes calculating a difference between said desired throttle position and said first throttle position value divided by said resolution value.

11. A method for controlling a throttle of an electronic throttle control-equipped engine, the method comprising the steps of:

generating a desired throttle position value having an associated first resolution value;

providing a second resolution value corresponding to a minimal throttle position increment resolution which is less than said first resolution value;

generating a rounded down throttle value less than said desired throttle position value and a rounded up throttle value greater than said desired throttle position value such that the difference between said rounded up and rounded down throttle values is equal to said second resolution value;

generating a duty cycle value by interpolating between said desired throttle position value and said rounded down value by said second resolution value; and generating a conditioned throttle position command as a function of said rounded down and rounded up throttle values and said duty cycle value.

12. The method of claim 11 wherein said rounded down throttle position has a resolution equal to said second resolution.

13. The method of claim 12 wherein said rounded up throttle position has a resolution equal to said second resolution.

14. The method of claim 11 further comprising the step of communicating said conditioned throttle position command to a throttle position controller.

15. The method of claim 14 wherein the step of communicating includes communicating said rounded down throttle position for a first predetermined period of time and communicating said rounded up throttle position for a second predetermined period of time such that the ratio of said first and second time periods corresponds to said duty cycle value.

16. The method of claim 15 wherein the sum of the first and second predetermined periods of time is constant for each desired throttle position value.

17. The method of claim 15 wherein the sum of the first and second predetermined periods of time is variable for each desired throttle position value.

* * * * *